US008253640B2

(12) United States Patent
Kitayoshi et al.

(10) Patent No.: US 8,253,640 B2
(45) Date of Patent: Aug. 28, 2012

(54) THIN SLOT ANTENNA HAVING CAVITY, ANTENNA POWER FEEDING METHOD, AND RFID TAG DEVICE USING THE ANTENNA AND THE METHOD

(75) Inventors: Hitoshi Kitayoshi, Miyagi (JP); Kunio Sawaya, Miyagi (JP)

(73) Assignee: Hitoshi Kitayoshi, Miyagi (JP)

( * ) Notice: Subject to any disclaimer, the term of this patent is extended or adjusted under 35 U.S.C. 154(b) by 632 days.

(21) Appl. No.: 12/440,152

(22) PCT Filed: Sep. 3, 2007

(86) PCT No.: PCT/JP2007/067145

§ 371 (c)(1),
(2), (4) Date: Apr. 3, 2009

(87) PCT Pub. No.: WO2008/029769

PCT Pub. Date: Mar. 13, 2008

(65) Prior Publication Data

US 2010/0188306 A1 Jul. 29, 2010

(30) Foreign Application Priority Data

Sep. 5, 2006 (JP) ..... 2006-239685

(51) Int. Cl.
*H01Q 13/00* (2006.01)
*H01Q 13/10* (2006.01)

(52) U.S. Cl. ..... 343/767; 343/746; 343/700 MS

(58) Field of Classification Search ..... 343/767, 343/700 MS

See application file for complete search history.

(56) References Cited

U.S. PATENT DOCUMENTS 4,587,524 A * 5/1986 Hall ..... 343/729
5,446,471 A * 8/1995 Chung et al. ..... 343/770
6,028,561 A * 2/2000 Takei ..... 343/767
6,034,644 A * 3/2000 Okabe et al. ..... 343/767

(Continued)

FOREIGN PATENT DOCUMENTS

JP 63-181505 7/1988

(Continued)

OTHER PUBLICATIONS

Kitayoshi, Hitoshi, K. Sawaya, "Slot Antenna Backed by a Flexible Thin Cavity," 2006 IEICE Society Conference, vol. B, pp. 1-96, Sep. 2006.*

(Continued)

*Primary Examiner* — Douglas W Owens
*Assistant Examiner* — Jennifer F Hu
(74) *Attorney, Agent, or Firm* — Young & Thompson

(57) ABSTRACT

A highly efficient thin slot antenna having a cavity and an RFID tag device are provided, in which such flexible properties can be provided to the antenna that the antenna can be worn on the curved surface of a human body, an object, or the like as well as the antenna can be relatively freely deformed, and changes in the characteristics caused by deformation and changes in the characteristics caused by a product to mount the antenna thereon. are extremely small. Conductive foil such as aluminum or foil vapor deposited with conductive metal such as aluminum is used to form a bag shape for configuring a bag-shaped product having a cavity (12). A relatively soft dielectric sheet (13) is provided inside the cavity (12), and a slot (14) is provided lengthwise on one side of the bag-shaped product at the center position in the width direction.

3 Claims, 13 Drawing Sheets

U.S. PATENT DOCUMENTS

| | | | | |
|---|---|---|---|---|
| 6,150,989 | A * | 11/2000 | Aubry | 343/767 |
| 6,259,369 | B1 | 7/2001 | Monico | |
| 6,388,630 | B1 | 5/2002 | Kurger et al. | |
| 6,480,162 | B2 * | 11/2002 | Sabet et al. | 343/767 |
| 6,563,463 | B1 | 5/2003 | Saito | |
| 6,975,276 | B2 * | 12/2005 | Brown | 343/767 |
| 7,148,848 | B2 * | 12/2006 | Colburn et al. | 343/700 MS |
| 8,077,096 | B2 * | 12/2011 | Chiang et al. | 343/702 |
| 2003/0169204 | A1 | 9/2003 | Saito | |
| 2004/0041741 | A1 * | 3/2004 | Hayes | 343/909 |
| 2005/0012673 | A1 * | 1/2005 | Parsche et al. | 343/767 |
| 2005/0179608 | A1 * | 8/2005 | Durham et al. | 343/770 |

FOREIGN PATENT DOCUMENTS

| | | |
|---|---|---|
| JP | 2000-332523 | 11/2000 |
| JP | 2001-143013 | 5/2001 |
| JP | 2002-026637 | 1/2002 |
| JP | 2002-252518 | 9/2002 |
| JP | 2002-271133 | 9/2002 |
| JP | 2003-510728 | 3/2003 |
| JP | 2005-149298 | 6/2005 |
| JP | 2005-277897 | 10/2005 |
| JP | 2009044439 A * | 2/2009 |

OTHER PUBLICATIONS

Tanaka, Masato, J. Jang, "Wearable microstrip antenna," Antennas and Propagation Society International Symposium, Jun. 22-27, 2003, IEEE.*

* cited by examiner

EXEMPLARY APPLICATION TO LONG-RANGE RESPONSE RFID TAG

THIN SLOT ANTENNA HAVING CAVITY, ANTENNA POWER FEEDING METHOD, AND RFID TAG DEVICE USING THE ANTENNA AND THE METHOD

TECHNICAL FIELD

The present invention relates to a thin slot antenna having a cavity, an antenna feeding method, and an RFID tag device using the antenna and the method.

BACKGROUND ART

Non-Patent Document 1: Masato Tanaka, RFID by using fabric antenna, Proceedings of IEICE General Conference 2006, B-1-173, March 2006

Non-Patent Document 2: Wearable microstrip antenna for satellite communications, IECE Transaction on Communications, vol. E87-B, no. 8, August 2004

Patent Document 1: JP 2002-352199 A

Patent Document 2: JP 2005-236858 A

In recent years, attention is focused on ubiquitous computing as the information environment in which computers exist everywhere in life and society and computers autonomously work together and operate to strongly support the everyday life of people, and this is partially realized.

In the ubiquitous computing, a computer can perform processing as automatically working together with other computers while referring to personal information and the like stored in networks, as necessary, although their presence is not perceived. For example, in addition to car navigation systems and the like, which search for routes and information about neighboring areas linked with VICS information, there are wearable computers that can be "worn" by combining a computer with a garment.

In addition, in a ubiquitous computing-oriented near future society, wireless communications are essential between computers.

For example, the above-described wearable computer may be an exercise monitor device integrated into a garment worn by a person, or an RFID tag device attached to various goods. Although light waves, radio waves, electromagnetic coupling, and so on can be considered to be a wireless communication means used in these devices, it can be thought that use of radio waves is the optimum in consideration of communication ranges, efficiency, etc.

On this occasion, antennas are indispensable to conduct communications according to radio waves. However, because it is not considered in typical antennas that antennas are freely deformed for use, a rigid material of relatively high shape retention is used for them. Furthermore, as a reason for using a rigid material of high shape retention, this is also due to avoidance of structural deformation that might lead to changes in the resonance frequency because antennas use resonance phenomena.

On the other hand, as the antenna for use in the above-described wearable computer, one of its conditions is deformable.

FIG. 15 is a cross section depicting an RFID according to a fabric microstrip antenna used in the Non-Patent Document 1, which uses an IC chip operated in the 2.45 GHz band.

In the drawing, in a fabric antenna 1, conductive woven fabric is used for an antenna patch 2 and a ground plane 3, and felt is used for a dielectric substrate 4. Furthermore, the polarization is right-handed circular polarization. For feeding power to the antenna, a rear pin feed method by an ultrasmall connector 5 is adopted, and an insulating layer through wiring 6 connects between the antenna patch 2 and the ground plane 3.

The conductive woven fabric used for the antenna patch 2 and the ground plane 3 is fabric used as an electromagnetic interference shielding material, and the fabric uses polyester thread each of which is treated with a metal coating. In addition, commercially available felt is used as the felt for the dielectric substrate 4, and the ultrasmall connector 5 is a publicly known connector for use in a mobile telephone.

Furthermore, as the structure of a so-called wearable antenna like this, in addition to the above-described Non-Patent Documents 1 and 2, for example, these techniques are considered: the technique in which as a wireless communication antenna having flexible properties that the antenna is worn mainly on the curved surface of a human body, an object, or the like and relatively freely deformed, an antenna of a reader/writer communicating with an RFID tag in a noncontact manner is integrally disposed on a bendable band by providing a catch on both end portions of the band, whereby the antenna is worn on the wrist to communicate information with the RFID tag attached to a package in a noncontact manner, packages can be loaded and unloaded with the antenna worn without putting on and off the antenna every time, even though an operator is driving a track or writing a delivery slip by hand, and thus the burdens of loading and unloading packages and management are reduced (see the Non-Patent Document 1); and the technique in which an antenna is formed in one piece with a strap mountable on a cellular telephone and the like, as a material for an antenna core, such a core material is used that the core material is formed of soft magnetic powder and an organic binder and is rich in flexibility and rubber elasticity, this core material is arranged on both sides of the strap, and wire is wounded to configure the antenna, whereby the antenna can be used in frequency bands lower than the AM band, and the antenna has high gains and impact resistance as well as flexibility and elasticity (the Non-Patent Document 2).

DISCLOSURE OF THE INVENTION

Problems that the Invention is to Solve

However, in the techniques disclosed in the Non-Patent Documents 1 and 2, such problems arise. The conductive woven fabric used for the antenna patch 2 and the ground plane 3 is relatively expensive. The resonance phenomena of the patch portion are used, and the patch size is relatively as large as about $\lambda/2\times\lambda/2$ with respect to the wavelength $\lambda$. Thus, changes in the characteristics caused by contact to the patch portion or by a product close to the portion are extremely large. Also, processing the antenna is difficult (mounting the antenna on the REID tag, the IC chip, etc.) because the insulating layer through wiring 6 connects between the antenna patch 2 and the ground plane 3 for feeding power to the antenna.

In addition, in the techniques disclosed in the Non-Patent Documents 1 and 2, such problems arise that the devices are inferior in flexibility along a human body shape and the like and in following the motion of a human body, and the devices are relatively expensive overall because a special core material and winding wire are used.

The present invention is made to solve the problems above.

It is an object of the present invention to provide a thin slot antenna having flexible properties that the antenna can be worn on the curved surface of a human body, an object, or the like as well as the antenna can be relatively freely deformed, and an RFID tag device.

It is an object of the present invention to provide a highly efficient, thin slot antenna whose changes in its characteristics caused by deformation and changes in its characteristics caused by a product to mount the antenna thereon are extremely small, and an RFID tag device.

It is an object of the present invention to provide a thin slot antenna having a cavity at much lower cost than conventional ones, and an RFID tag.

Means for Solving the Problems

A thin slot antenna having a cavity for use in wireless communications described in claim 1 is characterized by including: a bag-shaped product having a cavity defined with conductive foil or foil formed with a conductive thin film on the surface thereof, wherein a dielectric sheet is provided inside the cavity, and a slot is provided on one side of the foil by removing a conductor, thereby providing flexibility to the antenna such that the antenna is allowed to be mounted on a flat surface or a curved surface.

According to the described thin slot antenna having a cavity, a soft thin slot antenna relatively freely deformable can be fabricated at low costs. On this occasion, the slot can also be fabricated by a mask process in the process of vapor depositing metal on a dielectric film, not by cutting out the conductor.

Preferably, the dielectric sheet is soft enough to follow a human body for elastic deformation when the bag-shaped product is deformed along the curved surface of the human body or the like. In addition, preferably, the bag-shaped product may be a seamless bag-shaped product with no seams.

The thin slot antenna having a cavity described in claim 2 is characterized in that with respect to a radio frequency wavelength λ, the cavity has a thickness ranging from 0.01 to 0.05λ, a length ranging from 0.8 to 1.2λ, and a width ranging from 0.47 to 0.53λ.

According to the thin slot antenna having a cavity, coupling between the slot and the cavity becomes strong to improve antenna efficiency.

On this occasion, when the thickness is below 0.01λ, it is not preferable because the frequency band width of the antenna is narrow, whereas when the thickness exceeds 0.05λ, it is not preferable because the advantages of the low-profile structure are gone as compared with the other antenna structures such as an inverted F antenna and the like. Furthermore, the thickness ranging from 0.015 to 0.02λ is more preferable, even within the range of 0.01 to 0.05λ. In addition, when the length is below 0.8λ, it is not preferable because it is difficult to form the slot, whereas when the length exceeds 1.2λ, it is not preferable because the antenna becomes too long with respect to the slot length. Furthermore, the length ranging from 0.9 to 1.0λ is more preferable even within the range of 0.8 to 1.2λ. Moreover, when the width is below 0.47λ, it is not preferable because the resonance frequency of the antenna increases too high, whereas when the width exceeds 0.53λ, it is not preferable because the resonance frequency of the antenna drops too low.

Furthermore, the width ranging from 0.48 to 0.5λ is more preferable even within the range of 0.47 to 0.53λ.

The thin slot antenna having a cavity described in claim 3 is characterized in that the slot is provided lengthwise on one side of the cavity at a center position in a width direction, the slot having a width ranging from 0.01 to 0.05λ and a length ranging from 0.65 to 0. 85λ.

The thin slot antenna having a cavity described in claim 4 is characterized in that the dielectric sheet is formed of any one material of polypropylene and polystyrene. Particularly, polypropylene is preferable in view of the advantage of the present invention.

For the dielectric constant (1 kHz), polypropylene is in the range of 2.0 to 2.5, and polystyrene is in the range of 2.4 to 2.6. The other resins such as polyethylene may be properly used.

In this occasion, because a highly expanded material is used as the dielectric sheet to bring the dielectric constant close to that of air, dielectric losses are reduced to improve the efficiency of the antenna as well as high flexibility and a reduction in weight can be achieved.

The thin slot antenna having a cavity described in claim 5 is characterized in that the thickness of the dielectric sheet ranges from 0.01 to 0.05λ.

On this occasion, preferably, the size of the dielectric sheet is in the range of 2 mm to 3 mm, in consideration of processing properties and the range of changes in the thickness caused by external force. In addition, when the antenna is used in a 2.45 GHz band RFID, the thickness of 2 mm is 0.016λ, and when used in a 950 MHz band RFID, the thickness of 3 mm is 0.0095λ.

The thin slot antenna having a cavity described in claim 6 is characterized in that the conductive foil or the conductive thin film is formed of a single layer or a composite layer containing any one material of aluminum and copper.

On this occasion, when aluminum is used, light-weight, stable antenna characteristics can be obtained, and when copper is used, the conductivity can be increased at relatively low costs (the efficiency of the antenna becomes excellent because of low losses).

The thin slot antenna having a cavity described in claim 7 is characterized in that the thickness of the conductive foil ranges from 5 μm to 20 μm.

The thin slot antenna having a cavity described in claim 8 is characterized in that the thickness of the conductive thin film ranges from 0.5 μm to 10 μm.

The thin slot antenna having a cavity described in claim 9 is characterized in that the foil to be a base material for forming the conductive thin film is formed of any one of materials (polypropylene and polyester).

On this occasion, it is preferable to take account of the processing properties, strength, and softness for the thickness of the conductive film. It is significant that the thickness of the conductive thin film is about 5 μm for use in the 950 MHz band in consideration of the skin effect, and it is about 2 μm or greater for use in the 2.45 GHz band in order to improve the efficiency of the antenna. However, it can be thought that the thickness of the conductive foil is increased to deteriorate productivity such as deposition processes. In addition, preferably, the thickness of foil to be a base material for forming the conductive thin film ranges from 20 μm to 100 μm in consideration of the processing properties, strength, and softness. Furthermore, polypropylene and polyester are suited for aluminum vapor deposition.

Deposition may be conducted by using thin film formations according to vapor deposition, sputtering, CVD, and other thin film forming techniques. Particularly, vapor deposition is preferable.

The thin slot antenna having a cavity described in claim 10 is characterized in that an adhesive conductive tape has a slot (hereinafter, referred to as a tape slot) in the same shape as the slot and has an IC chip and a coaxial cable connected thereto in advance such that the IC chip and the coaxial cable are electrically connected across the tape slot, and the adhesive conductive tape is bonded to the foil such that positions of the slot and the tape slot are matched.

According to the thin slot antenna having a cavity, to the thin slot antenna having a cavity formed of inexpensive materials thermally mechanically weak, a feeder circuit formed of a material relatively thermally mechanically strong is bonded to fabricate an inexpensive antenna device.

The thin slot antenna having a cavity is characterized in that an IC chip and a coaxial cable are electrically connected in advance to two adhesive conductive electrodes, the two adhesive conductive electrodes being relatively easily electrically connectable, and the two adhesive conductive electrodes are bonded over the slot such that the two adhesive conductive electrodes do not block the slot, thereby using capacitive coupling of cavity conductors above and below the slot to the two adhesive conductive electrodes, respectively.

According to the thin slot antenna having a cavity, an RFID tag IC chip having a dipole antenna, which is generally used, is placed such that the IC chip position is at the slot position, and the dipole antenna is bonded over the slot to the thin slot antenna having a cavity according to the present invention, whereby the communication range of the RFID tag is extended as well as the RFID tag can be used as the tag is brought into close contact with a human body, or the like.

The thin slot antenna having a cavity described in claim 12 is characterized in that a feeding point is provided at a position 0.1 to 0.2λ apart from one end of the slot to obtain 50 Ω feed point impedance.

According to the thin slot antenna having a cavity described in claim 12, the antenna can be matched with an IC chip having a 50 Ω load and matched with a coaxial cable most commonly used.

The thin slot antenna having a cavity described in claim 13 is characterized in that on the side of the conductive foil or the foil on which the conductive thin film is formed, several holes are uniformly made on a side on which the slot is not provided and on the dielectric sheet as the vicinity of the slot is avoided.

According to the thin slot antenna having a cavity described in claim 13, even though the thin slot antenna having a cavity is sewn on a garment or the like, several holes can be used as drain holes and air vents, and the garment can be easily washed and dried.

An RFID tag device described in claim 14 is characterized by using the thin slot antenna having a cavity according to any one of claims 1 to 13.

An RFID tag device described in claim 15 is characterized by using the antenna according to any one of claims 1 to 13 to configure a structure, wherein an IC chip is connected across the slot and a third terminal is provided for modulating a return reflected wave in addition to two feed terminals, wherein one end of the slot is extended to cause feed point impedance not to match with a receiving power matching state, and a variable impedance device is mounted on the extended slot, and the variable impedance device is controlled by the third terminal.

According to the RFID tag device described in claim 15, as the variable impedance device, a device such as a varactor diode is used, in which low impedance can be obtained in radio frequencies when bias is zero and high impedance can be obtained when bias is applied, whereby a highly efficient tag return response signal can be obtained.

An RFID tag device described in claim 16 is characterized by using the antenna according to any one of claims 1 to 13 to configure a structure, wherein an IC chip is connected across the slot and a third terminal is provided for modulating a return reflected wave in addition to two feed terminals, wherein a semiconductor device is mounted at a position off from a feeding point of the slot, and the semiconductor device is controlled by the third terminal.

According to the RFID tag device, as a semiconductor device, a device such as a PIN diode is used, in which high impedance is obtained in radio frequencies when bias is zero and low impedance is obtained when bias is applied, whereby a highly efficient tag return response signal can be obtained.

Advantage of the Invention

According to the present invention, a cavity is defined with a bag using conductive foil or a sheet vapor deposited with conductive metal such as aluminum, a relatively soft dielectric sheet is provided inside the cavity, and a slot is provided lengthwise on one side of the cavity at the center position in the width direction, whereby a highly efficient thin slot antenna having a cavity and an RFID tag device can be formed. The antenna can be provided with flexible properties that the antenna can be worn on the curved surface of a human body, an object, or the like as well as the antenna can be relatively freely deformed, and the antenna has extremely small changes in its characteristics caused by deformation and changes in its characteristics caused by a product to mount the antenna thereon.

DESCRIPTION OF REFERENCE NUMERALS AND SIGNS

11 thin slot antenna having a cavity (antenna)
12 cavity
13 highly expanded polypropylene sheet (dielectric sheet)
11 slot
15 copper tape
16 feeding point Best Mode for Carrying out the Invention Next, embodiments of a thin slot antenna having a cavity and an RFID tag device according to the present invention will be described with reference to the drawings.

Figure 1:
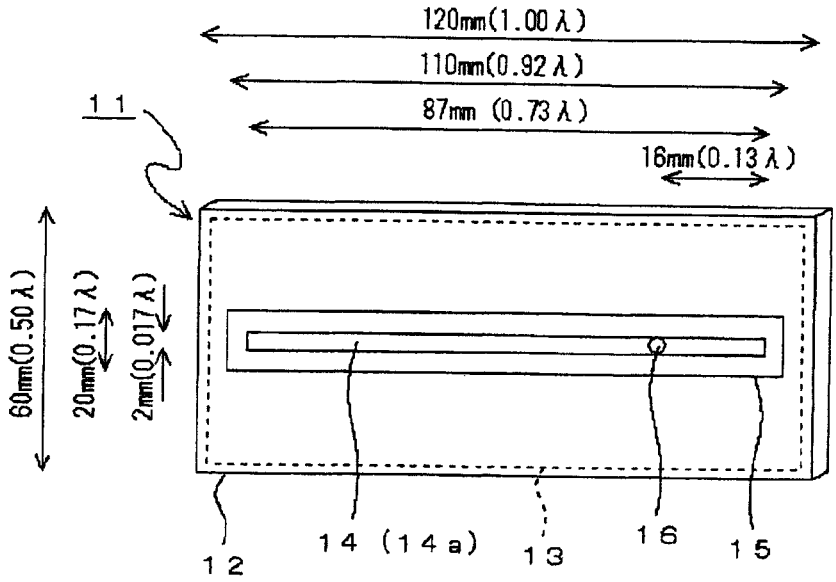
FIG. 1 is a perspective view depicting a thin slot antenna having a cavity according to the present invention.

FIG. 1 is a perspective view depicting a thin slot antenna having a cavity, showing an embodiment of the present invention.

In FIG. 1, a bag-shaped product 11 having a cavity 12 is configured of conductive foil, a soft dielectric sheet 13 is provided inside the cavity 12, and a slot 14 is provided on one side of the conductive foil by partially removing the conductive foil. This bag-shaped product becomes a thin slot antenna having a cavity for use in wireless communications with flexibility such that the antenna can be mounted on the flat surface or the curved surface.

Hereinafter, the embodiment will be described more in detail.

In FIG. 1, the thin slot antenna having a cavity (simply referred to as the "antenna" below) 11, for example, has the cavity 12 (resonance cavity) in a bag shape, which is defined with aluminum foil or a sheet with vapor deposited aluminum, the highly expanded polypropylene sheet 13 having a thickness of 2 mm provided inside the cavity 12, the slot 14 defined by a copper tape 15 or the like bonded to one surface of the cavity 12, and a feeding point 16 positioned in the slot 14. Furthermore, the dimensions of each of the cavity 12, the highly expanded polypropylene sheet 13, the slot 14, the copper tape 15, and the feeding point 16 are depicted in parentheses in the drawings as the dimensions are normalized by a radio wave of wavelength λ in the case of the design frequency of 2.5 GHz band, and they can be applied not only to the 2.5 GHz band but also to various frequency bands.

The antenna 11 has a very simple structure in which the cavity 12 is defined with a bag-shaped sheet of aluminum foil or a bag-shaped sheet with vapor deposited aluminum, a relatively thin, soft highly expanded polypropylene sheet is provided inside the cavity, and the narrow slot 14 is provided. In addition, the resonance frequency of the antenna 11 is determined by the cavity width (60 mm, 0.5λ) in the direction perpendicular to the slot. The length of the slot 14 (110 mm) and the position of the feeding point 16 (16 mm) are determined by the matching conditions with load impedance, and the dimensions in FIG. 1 are the case of the most common load, 50 Ω.

Hereinafter, as the cavity 12 in the case of the antenna 11 adapted to the 2.5 GHz band, such a prototype is used that the prototype uses aluminum foil having a thickness of 12 μm (household aluminum foil or the like) or a vapor deposited aluminum film relatively thick (snack bag). Because the prototype is susceptible to heat and it is difficult to apply soldering and the like to the prototype, the prototype was produced in such a way that the slot 14 was provided in advance to a bag for defining the cavity 12, a slit 14*a* similar to the slot 14 was provided to the copper tape 15, a coaxial cable was soldered to the tape 15 as the feeding point 16, and then the tape 15 was bonded to the bag. In the antenna 11 having this structure, as similar to the conventional fabric patch antenna, because the antenna 11 is relatively easily deformable and its radiation to the back side direction is small, degradation in its characteristics is rarely observed, even though the antenna 11 is bonded to a product for use.

In addition, it can also be expected to improve the following disadvantages of the fabric patch antenna.

(1) Costs are low because an aluminum sheet and a highly expanded polypropylene (generally a cushioning material) are used for the cavity 12.

(2) Changes in the characteristics caused by contact to the portions other than the slot 14 or by a product close to the portion are extremely small because the resonance phenomena of the cavity 12 are used. (Although such a phenomenon is observed that feed point impedance is changed by contact to the slot 14, the area of the susceptible portions is extremely smaller than that of the patch antenna).

(3) Mounting the antenna on an RFID tag IC chip and the like is facilitated because the antenna feed is the short-circuit point of the slot on the slot 14, Hereinafter, the evaluation results of the antenna using the above-described prototype are shown in FIGS. 2 to 5.

Figure 2:
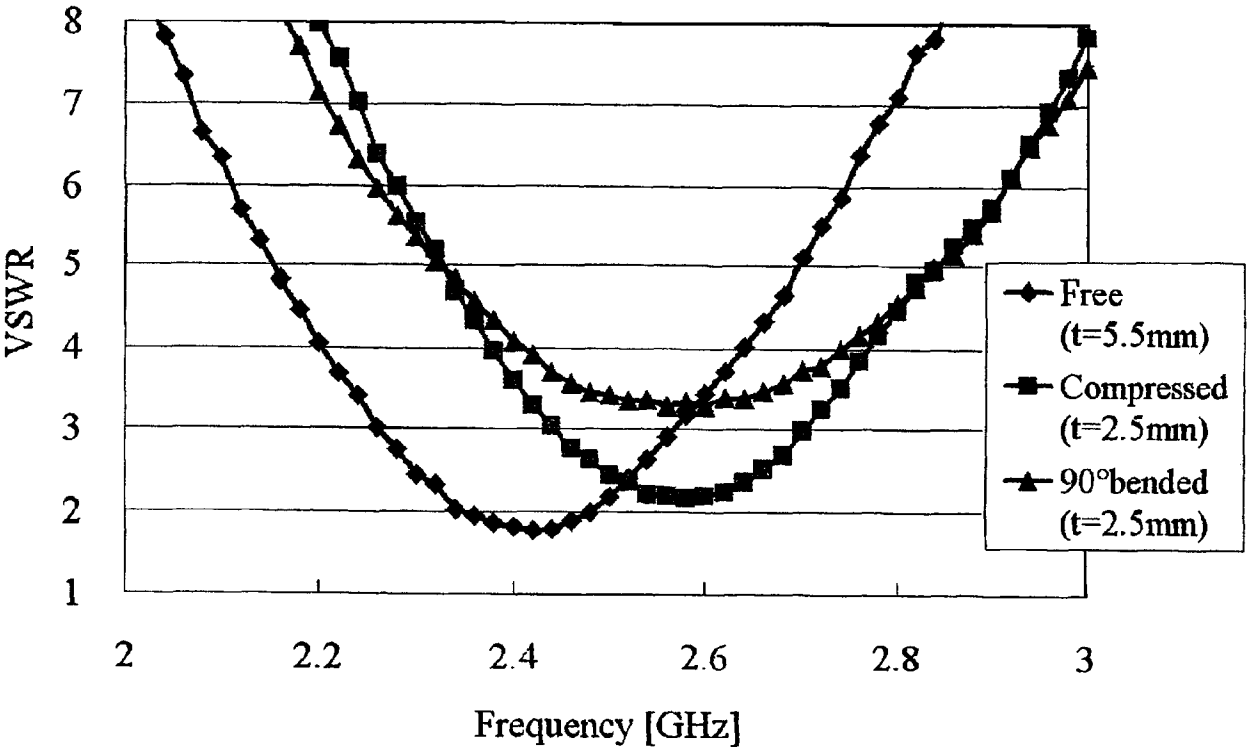
FIG. 2 is a graph depicting the thin slot antenna having a cavity according to the present invention, showing the VSWR frequency response of a prototype thin slot antenna having a cavity.

FIG. 2 shows the results of evaluating the VSWR (Voltage Standing Wave Ratio) frequency response of a soft, thin prototype slot antenna having a cavity for use in the 2.5 GHz band.

In FIG. 2, Free indicates the result that the antenna was measured in the thickness of 5.5 mm with no application of external force, Compressed indicates the result that the antenna was compressed to the thickness of 2.5 mm as flattened with the application of external force, and 90° bended indicates the result that the antenna was bent at an angle of 90° in the thickness of 2.5 mm with the application of external force. In any of these cases, the resonance frequency is in the range of 2.4 to 2.6 GHz, and the VSWR is about three or below in the 2.5 GHz band.

Figure 3:
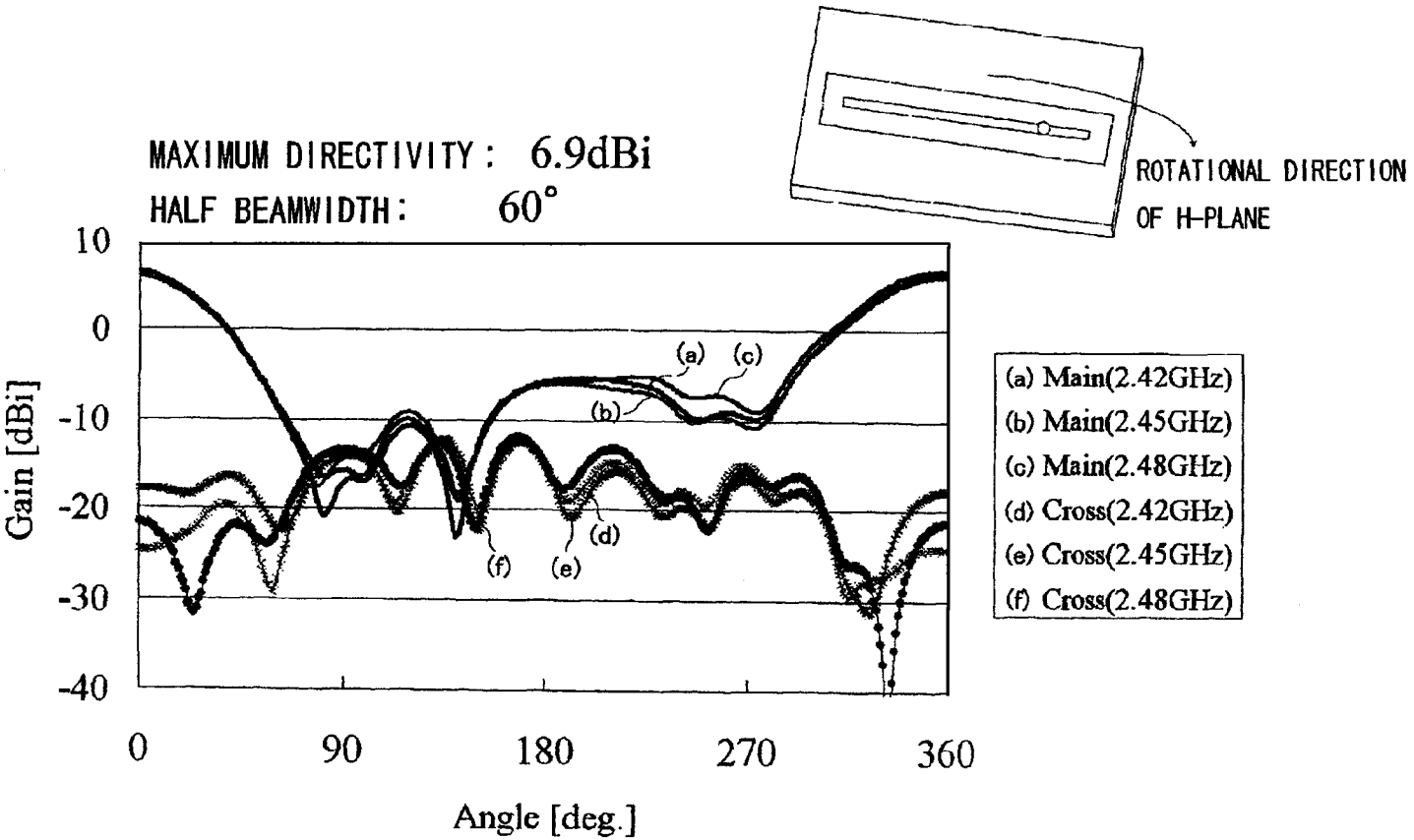
FIG. 3 is a graph depicting the thin slot antenna having a cavity according to the present invention, showing the H-plane directivity of a prototype thin slot antenna having a cavity defined with aluminum foil (a thickness of 12 μm) (with no phantom)
Figure 4:
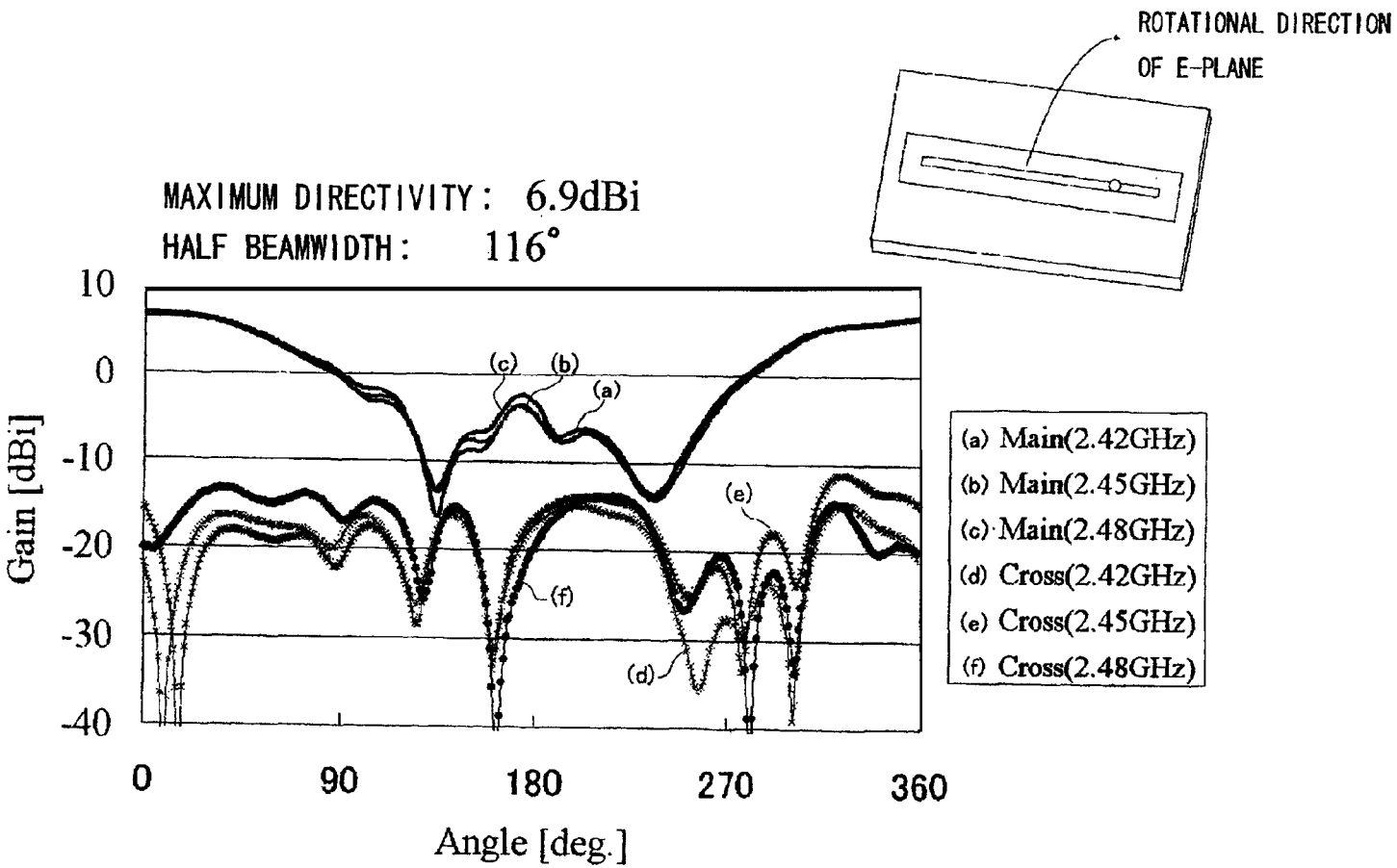
FIG. 4 is a graph depicting the thin slot antenna having a cavity according to the present invention, showing the E-plane directivity of a prototype thin slot antenna having a cavity defined with aluminum foil (a thickness of 12 μm) (with no phantom)

FIGS. 3 and 4 show the evaluation results of the directive gains of main polarization and cross polarization in the H-plane of a prototype antenna 11 (in the horizontal rotational direction in FIG. 1) and the E-plane thereof (in the vertical rotational direction in FIG. 1). The performance of selecting polarization was 20 dB or greater, and the maximum directivity was 6.9 dBi. The half beamwidth of the E-plane is at an angle of 116° almost twice as wide as that of the H-plane, 60°, and this is because the slot magnetic current has the spread in the H-plane direction (the wider the radiation of the antenna 11 becomes, the narrower the beam is).

Figure 5:
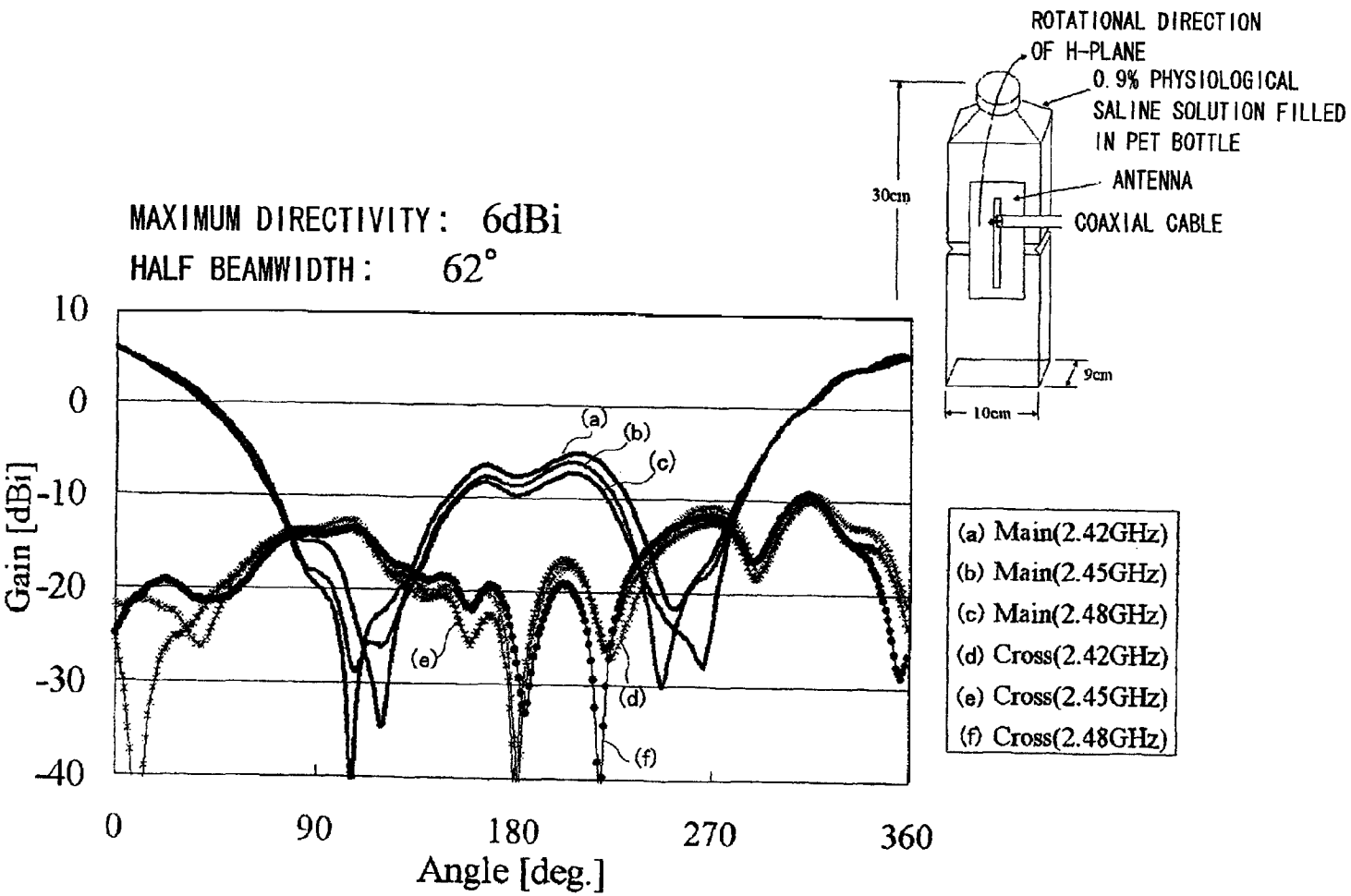
FIG. 5 is a graph depicting the thin slot antenna having a cavity according to the present invention, showing the H-plane directivity of a prototype thin slot antenna having a cavity defined with aluminum foil (a thickness of 12 μm) vertically contacted on a phantom.
Figure 6:
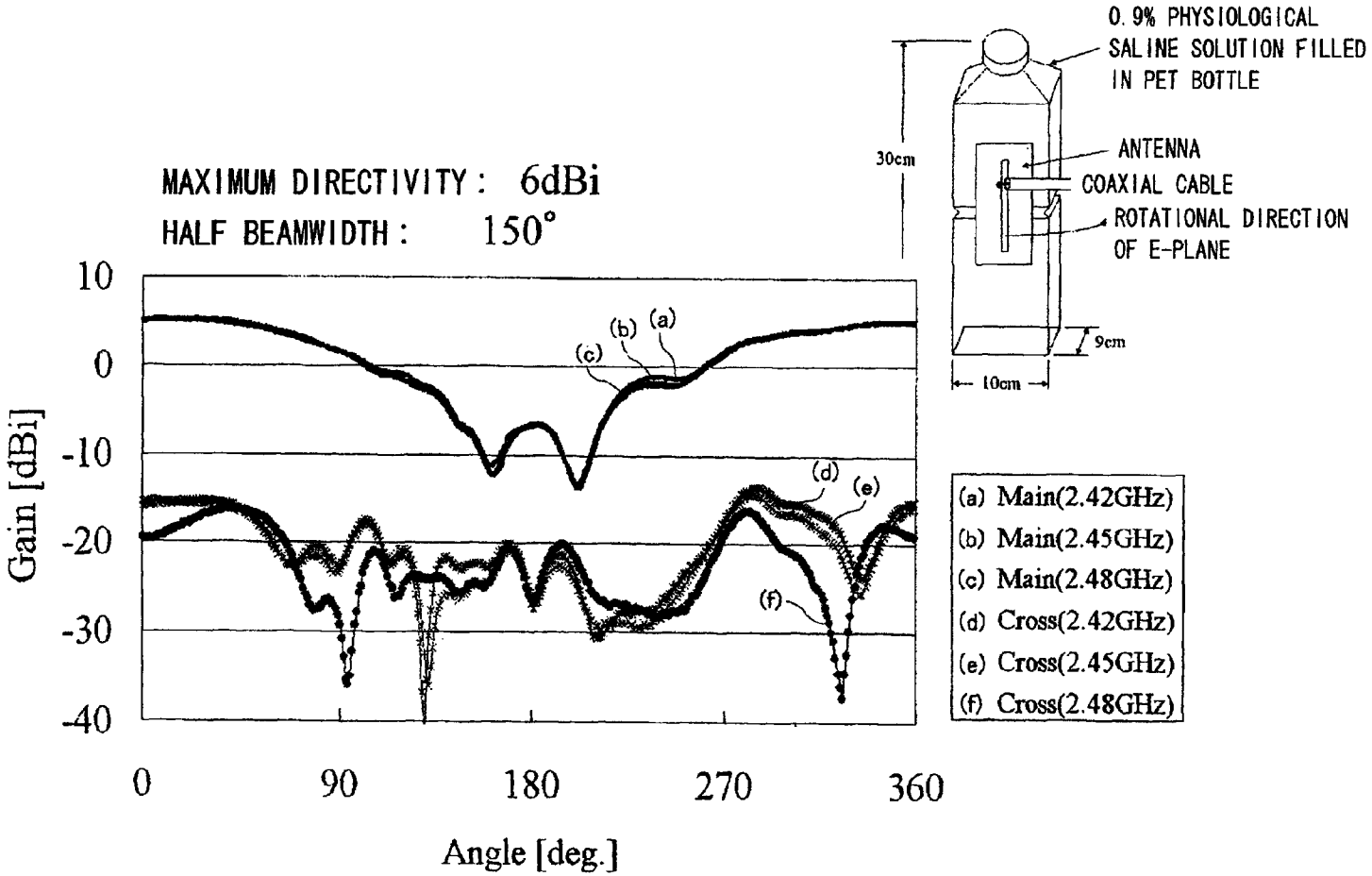
FIG. 6 is a graph depicting the thin slot antenna having a cavity according to the present invention, showing the E-plane directivity of a prototype thin slot antenna having a cavity defined with aluminum foil (a thickness of 12 μm) vertically contacted on a phantom.

FIGS. 5 and 6 show the directive gains of main polarization and cross polarization in the H-plane and the E-plane, in which a prototype antenna 11 was brought into close contact with a phantom (a two-liter PET bottle filled with 0.9% physiological saline solution) for evaluation such that the slot 14 was vertically placed. Furthermore, in the descriptions below, a coaxial cable was connected in advance to an adhesive conductive tape or the like, which has a slot in the same shape as that of the slot 14 and is relatively easily electrical connectable, such that the cable was electrically connected across the slot, and then the tape was bonded to the slot antenna as the slot positions were matched with each other.

Although the performance of selecting polarization and the H-plane directivity are almost the same as the case in which the antenna is not bonded to the phantom, the E-plane directivity is spread because of the influence of the phantom, and the maximum directivity is decreased by 0.9 dB.

Figure 7:
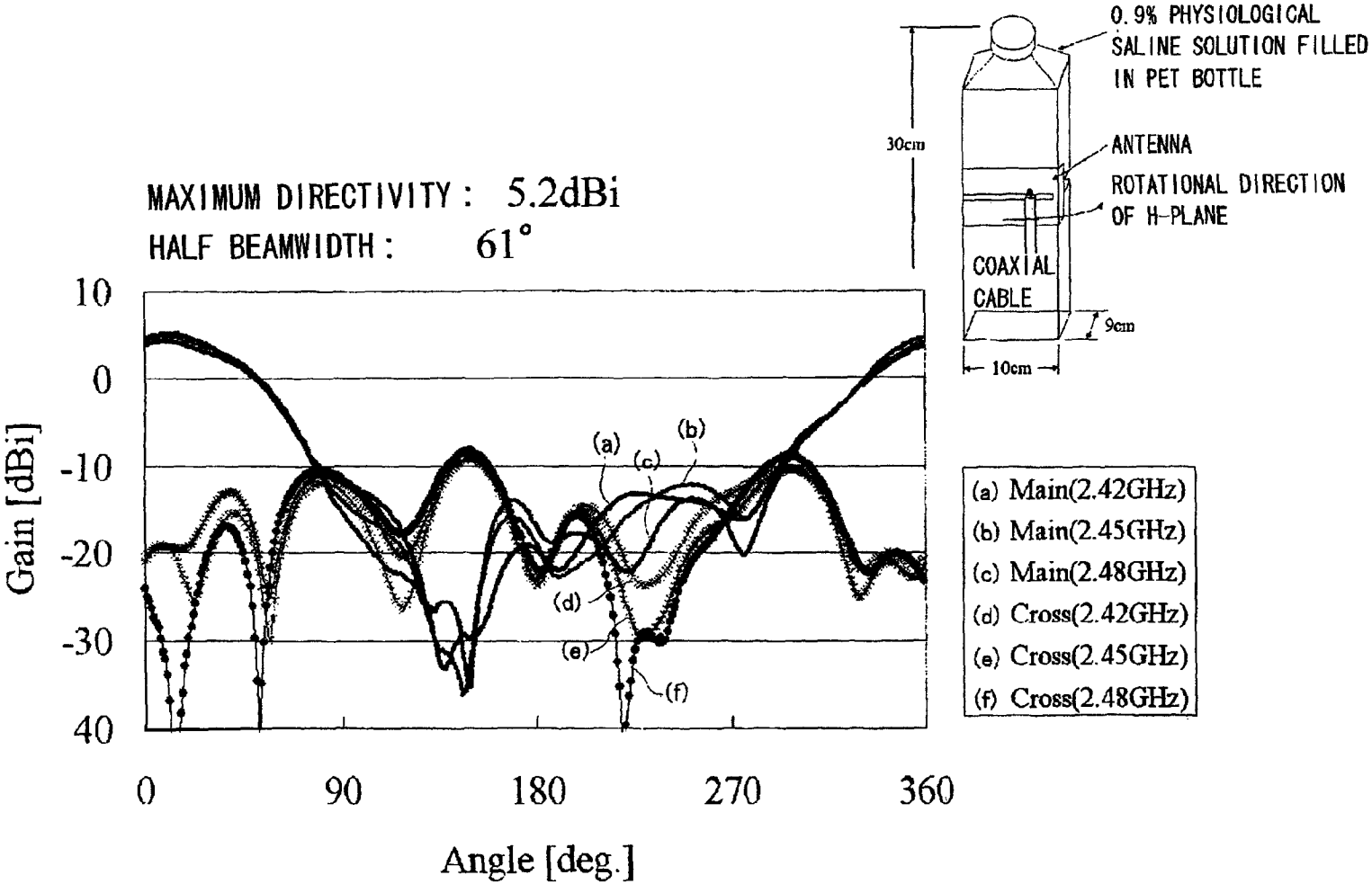
FIG. 7 is a graph depicting the thin slot antenna having a cavity according to the present invention, showing the H-plane directivity of a prototype thin slot antenna having a cavity defined with aluminum foil (a thickness of 12 μm) laterally contacted on a phantom.

FIG. 7 shows the directive gains of main polarization and cross polarization of the H-plane, in which a prototype antenna 11 was brought into close contact with a phantom for evaluation such that the slot 14 was laterally placed. As compared with the case of vertically attaching the antenna shown in FIG. 5, although the half beamwidth is little changed, the cross polarization is increased by a small amount, and the maximum directivity of main polarization is decreased by 0.8 dB. It can be thought that this is caused from a fact that each of both ends of the antenna having a width of 12 cm was bent by a length of 1 cm and then attached on the phantom having a width of 10 cm.

Figure 8:
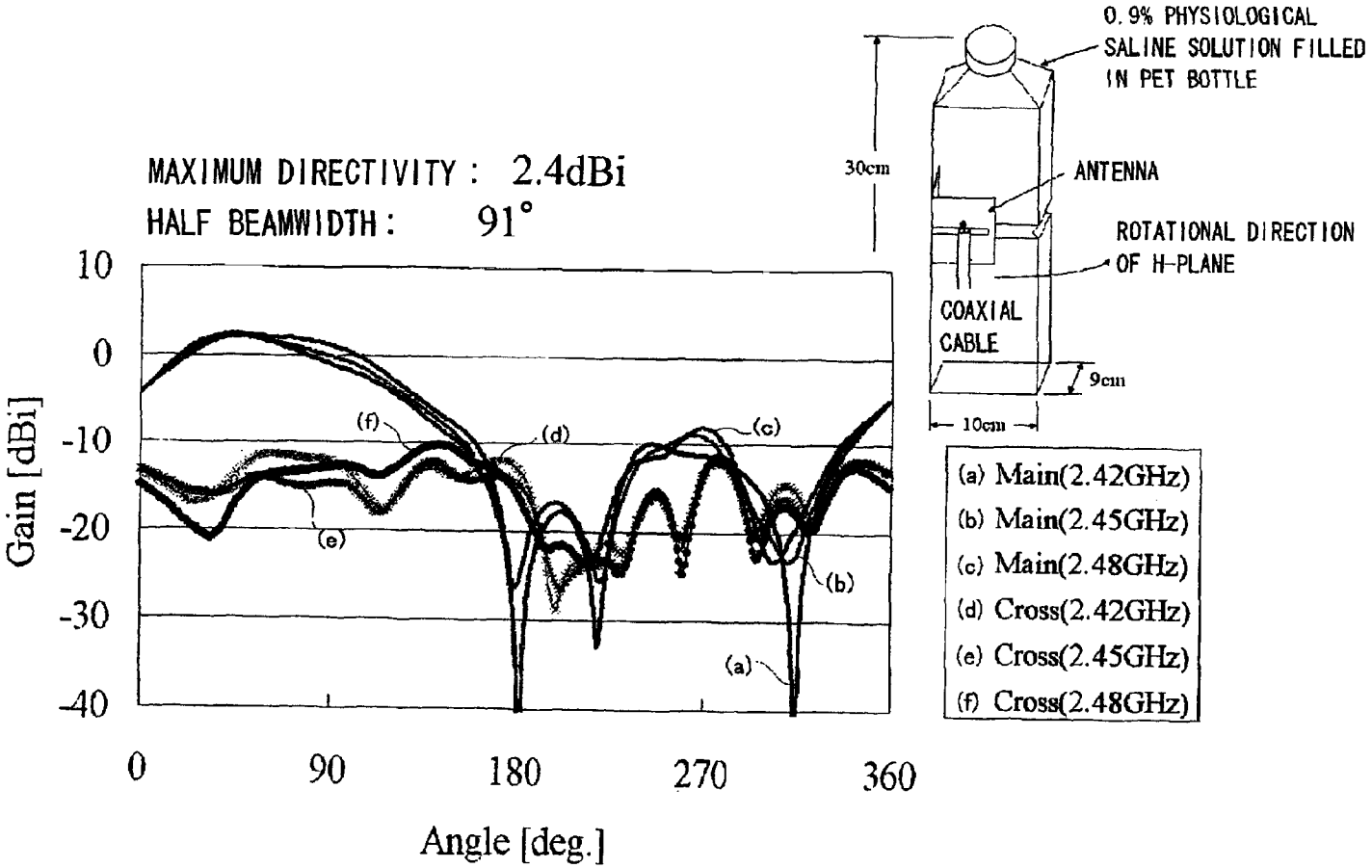
FIG. 8 is a graph depicting the thin slot antenna having a cavity according to the present invention, showing the H-plane directivity of a prototype thin slot antenna having a cavity defined with aluminum foil (a thickness of 12 μm) laterally contacted on a phantom over the corners.

FIG. 8 shows the directive gains of main polarization and cross polarization of the H-plane, in which a prototype antenna 11 was brought into close contact with the corner portion of a phantom (two sides) and the slot 14 was placed laterally. As compared with the case shown in FIG. 7 in which the antenna was attached almost flat, although the level of cross polarization is nearly equal, the half beamwidth of main polarization is spread, and this causes a 2.8 dB reduction in the maximum directivity.

Figure 9:
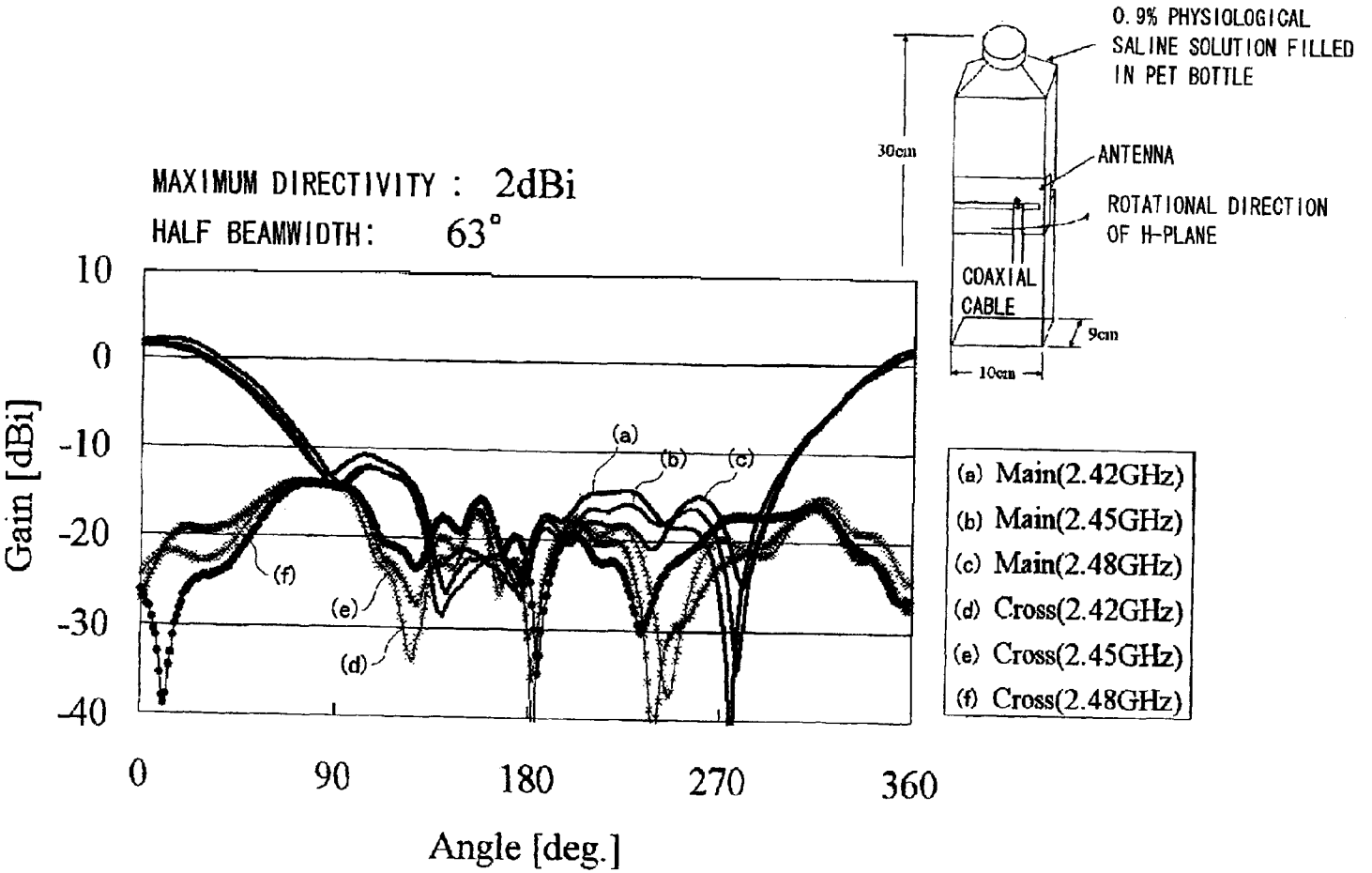
FIG. 9 is a graph depicting the thin slot antenna having a cavity according to the present invention, showing the H-plane directivity of a prototype thin slot antenna having a cavity defined with a thick vapor deposited aluminum film laterally contacted on a phantom.
Figure 10:
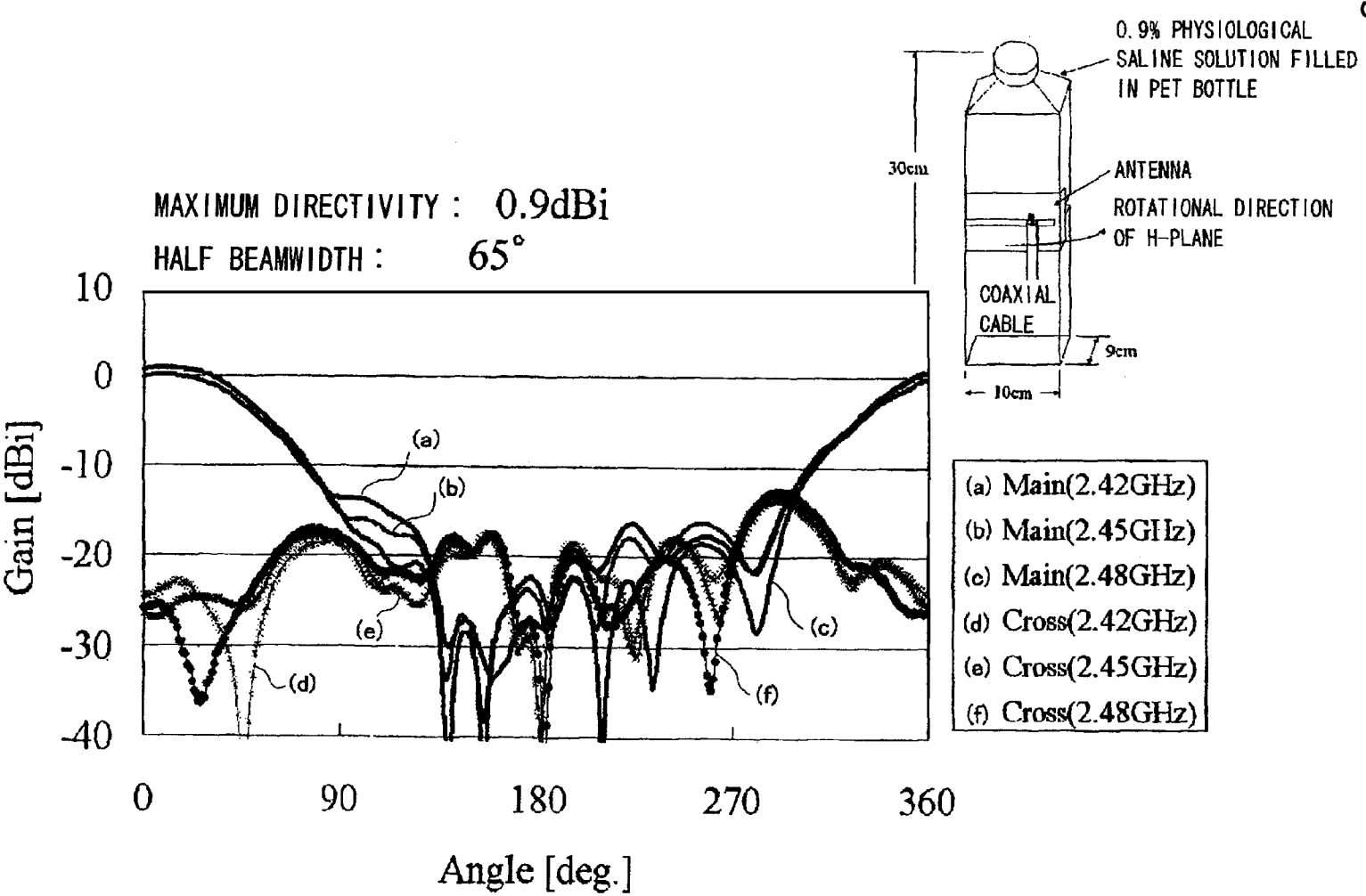
FIG. 10 is a graph depicting the thin slot antenna having a cavity according to the present invention, showing the H-plane directivity of a prototype thin slot antenna having a cavity defined with a thin vapor deposited aluminum film laterally contacted on a phantom.

FIGS. 9 and 10 show the directive gains of main polarization and cross polarization of the H-plane, in which a prototype antenna 11 using a vapor deposited aluminum film for a bag-shaped sheet material defining the cavity was brought into close contact with a phantom for evaluation such that the slot 14 was laterally placed. As compared with the case shown in FIG. 7 in which aluminum foil having a thickness of 12 μm was used, although the half beamwidth of main polarization is nearly equal, the level of main polarization and the level of cross polarization are both decreased. When the peak gain of main polarization is compared, 3.2 dB is decreased in the case of the thick vapor deposited aluminum film, whereas 4.3 dB is decreased in the case of the thin vapor deposited aluminum film. The depth of the skin effect of aluminum in the 2.5 GHz band is about 1.6 μm, and a cavity having a sufficiently high Q value is defined with aluminum foil having a thickness of 12 μm. On the other hand, it is thought that losses appeared in the cavity because of an insufficient thickness of the aluminum layer of the vapor deposited aluminum film. It can be considered that a thickness of 3 μm is enough for the thickness of the aluminum layer in the 2.5 GHz band When the vapor deposited film is used, it is desired that the thickness of the aluminum layer is greater than the depth of skin effect in the frequency for use.

Figure 11:
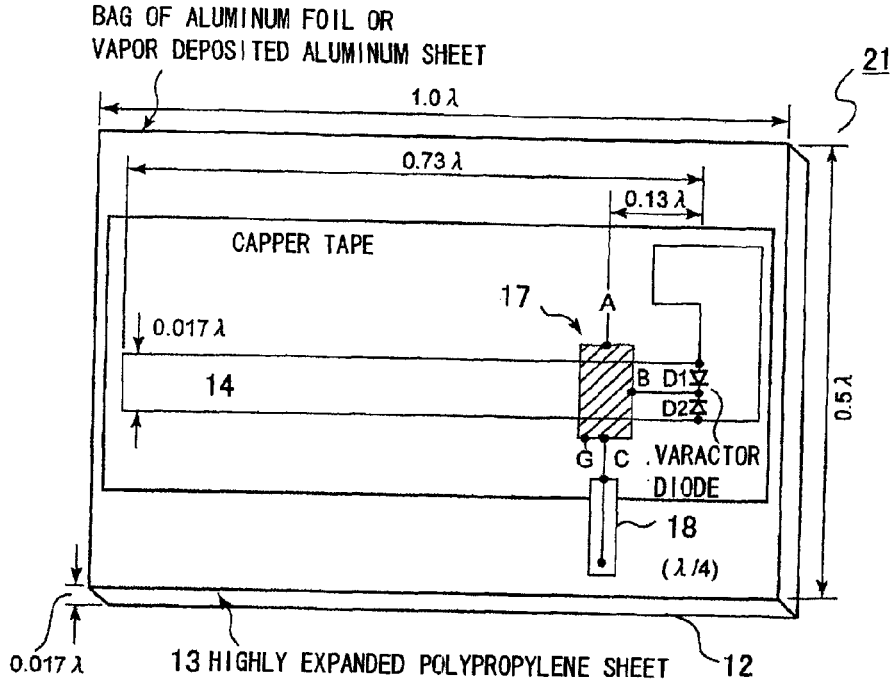
FIG. 11 is a perspective view depicting another thin slot antenna having a cavity according to the present invention.
Figure 12:
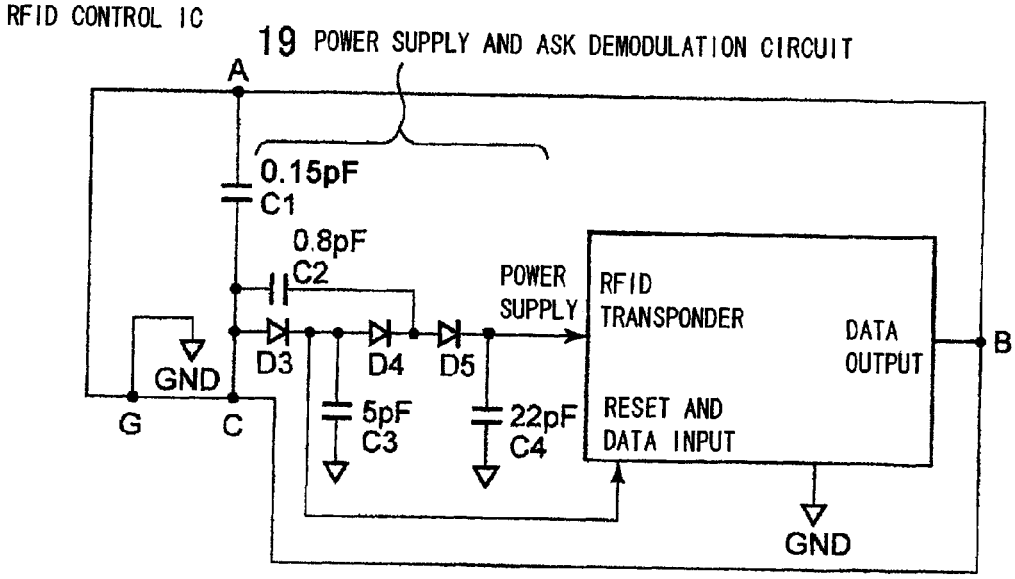
FIG. 12 is a circuit diagram depicting the essential part of another thin slot antenna having a cavity according to the present invention.

FIGS. 11 and 12 show another antenna 21. 12 denotes a cavity, 13 denotes a highly expanded polypropylene sheet, 14 denotes a slot, 17 denotes a control IC, 18 denotes a short stub, 19 denotes a demodulation circuit, D1 and D2 denote a varactor diode, C1 to C4 denote a condenser, and D3 to D5 denote a Schottky barrier diode.

Here, with the varactor diodes D1 and D2, when the output of a terminal B is at Low level (the REID control IC 17 is not responding), the slot is in the short-circuited state at this position for feed point impedance matching between a terminal A and a terminal G at 50 Ω.

In addition, the λg/4 short stub 18 for pressure rising is connected between a terminal C and the terminal G (λg is the effective wavelength of a transmission line). When the output of the terminal B is at High level, the slot 14 is in the open state and elongated at the positions of the varactor diodes D1 and D2, and impedance between the terminal A and the terminal G is not matched with 50 Ω, whereby the response signal can be reflected.

As described above, in the thin slot antenna having a cavity and the RFID tag device according to the present invention, it is an antenna for use in wireless communications having flexible properties that the antenna is worn mainly on the curved surface of a human body, an object, or the like and relatively freely deformed, in which the cavity 12 is defined with bag-shaped conductive foil or a bag-shaped sheet vapor deposited with conductive metal such as aluminum, the relatively soft highly expanded polypropylene sheet 13 is provided as a dielectric sheet inside the cavity 12, and the slot 14 is provided lengthwise on one side of the cavity 12 at the center position in the width direction.

Therefore, the resonance phenomena of the cavity 12 defined in a bag shape are used to fabricate a small, thin, light-weight antenna 11 of more flexibility and elasticity at low costs as well as to provide a highly efficient antenna 11 having extremely small changes in its characteristics caused by deformation and changes in its characteristics caused by a product to mount the antenna thereon, and the antenna 11 is used to provide an RFID tag device having a long communication range.

Figure 13:
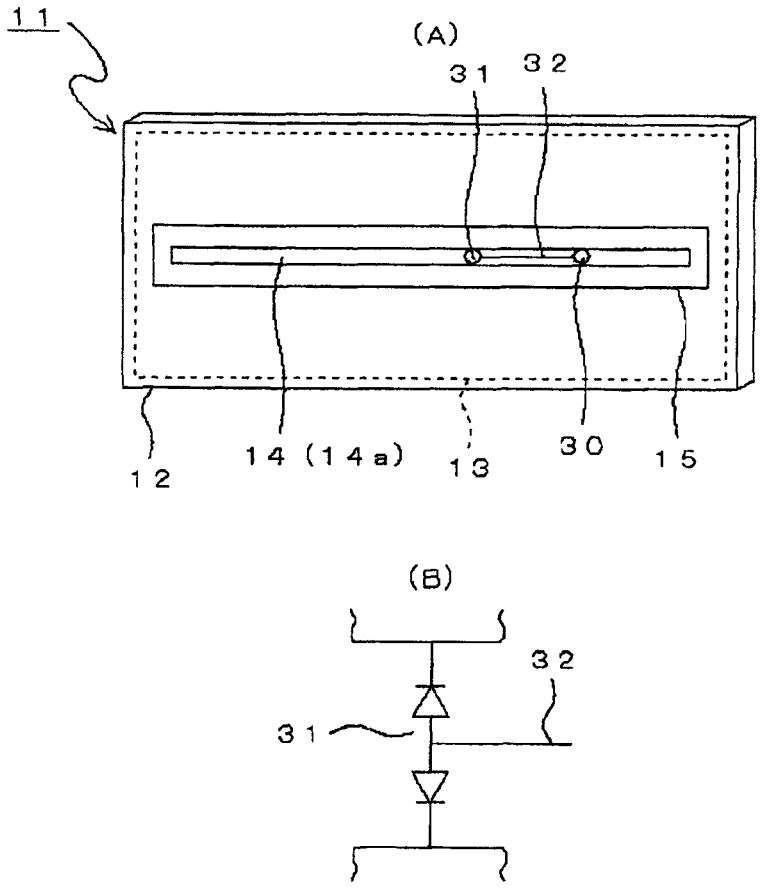
FIG. 13(A) is a front view depicting still another thin slot antenna having a cavity according to the present invention.
FIG. 13(B) is an illustration depicting the essential part of the antenna.

In addition, as shown in FIGS. 13(A) and 13(B), in the case in which an RFID tag IC chip 30 is not in a two-terminal structure and has a third terminal to modulate the return reflected value, a PIN diode (or a transistor device) 31 is provided at a slot position off from the slot feeding point (the mounting position of the RFID tag IC chip 30) for line connection 32, and this is controlled by the third terminal, whereby a highly efficient return reflected value can be obtained. On this occasion, the PIN diode 31 is in the high impedance state (opened) when bias is zero at radio frequencies, whereas it is in the low impedance state (short-circuited) when bias is applied.

Figure 14:
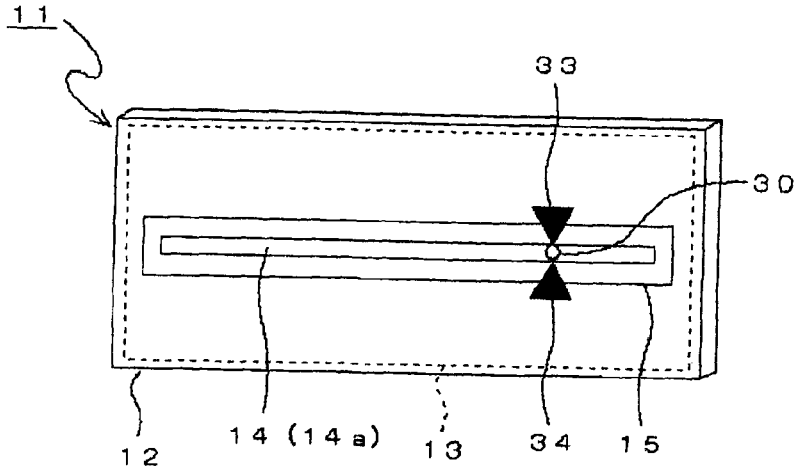
FIG. 14 is a perspective view depicting yet another thin slot antenna having a cavity according to the present invention.
Figure 15:
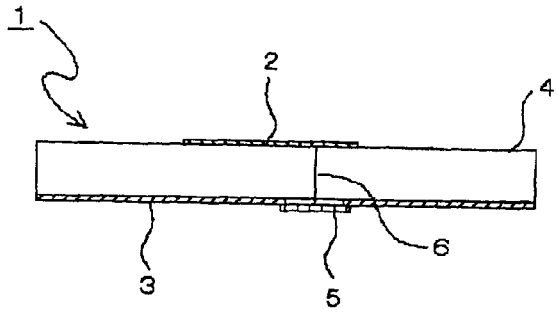
Fig. 15 Prior Art
FIG. 15 is a cross section depicting a conventional fabric microstrip antenna.

Moreover, as shown in FIG. 14, such a feeding method is also possible in which an IC chip 30 and a coaxial cable (not shown) are electrically connected in advance to two adhesive conductive electrodes 33 and 34, which are relatively easily electrically connectable, and the two adhesive conductive electrodes 33 and 34 are bonded over the slot 14 such that the two adhesive conductive electrodes 33 and 34 do not block the slot 14, whereby cavity conductors above and below the slot 14 are capacitively coupled to the two adhesive conductive electrodes 33 and 34, respectively.

Therefore, as a thin slot antenna having a cavity, a dipole antenna (a coaxial cable or the like) is bonded over the slot 14 at the slot position matched with the IC chip position of an RFID tag IC chip having the dipole antenna generally used, whereby the communication range of the RFID tag can be extended as well as the RFID tag can be used as the tag is brought into close contact with a human body or the like.

On this occasion, several holes are uniformly made in the cavity 12, whereby the holes can be used as drain holes and air vents when a garment sewn with the RFID tag device is washed, and the cavity 12 can easily contain water and easily drain the water to facilitate washing the garment sewn with the RFID tag device.

Industrial Applicability

A highly efficient thin slot antenna having a cavity and an RFID tag device can be provided, in which the cavity is defined with a bag using conductive foil or a sheet vapor deposited with conductive metal such as aluminum or the like, a relatively soft dielectric sheet is provided inside the cavity, and a slot is provided lengthwise on one side of the cavity at the center position in the width direction, whereby such flexible properties can be provided to the antenna that the antenna can be worn on the curved surface of a human body, an object, or the like as well as the antenna can be relatively freely deformed, and changes in its characteristics caused by deformation and changes in its characteristics caused by a product to mount the antenna thereon are extremely small.

The invention claimed is:

1. A thin slot antenna for use in wireless communications with radio frequency wavelength λ, comprising:

a closed cavity defined by walls of a flexible conductive foil or a substrate with a conductive thin film on the surface thereof;

a dielectric sheet inside the cavity;

a linear slot through at least one of the walls of the cavity;

an adhesive conductive tape on one of the walls of the cavity over the slot; and a tape slot in the tape having a same shape as the linear slot, wherein the tape is bonded to the foil or substrate so that positions of the tape slot and the linear slot coincide so that an antenna feeding point on the tape slot is bonded over the linear slot.

2. An RFID tag device comprising the thin slot antenna according to claim 1, further comprising an IC chip that includes a third terminal for modulating a return reflected wave in addition to two feed terminals connected to the adhesive conductive tape on opposite sides of the tape slot, wherein one end of the linear slot is extended by about λ/4 to cause feed point impedance not to match with a receiving power matching state, and wherein a variable impedance device is mounted across the extended slot, and the variable impedance device is controlled by the third terminal.

3. An RFID tag device comprising the thin slot antenna according to claim 1, further comprising an IC chip connected across the linear slot and having two feed terminals, the IC chip having a third terminal for modulating a return reflected wave in addition to two feed terminals, and a variable impedance semiconductor device mounted at a position spaced from the antenna feeding point, wherein the semiconductor device is controlled by the third terminal.

* * * * *